US009987871B1

(12) United States Patent
Larson et al.

(10) Patent No.: US 9,987,871 B1
(45) Date of Patent: Jun. 5, 2018

(54) GREETING CARD WITH MOTORIZED GIFT CARD HOLDER

(71) Applicant: American Greetings Corporation, Cleveland, OH (US)

(72) Inventors: Seth Larson, Lakewood, OH (US); Dave Sapp, Avon Lake, OH (US); Nicole Forrester, Cleveland, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days. days.

(21) Appl. No.: 15/796,371

(22) Filed: Oct. 27, 2017

(51) Int. Cl.
*B42D 15/00* (2006.01)
*B42D 15/04* (2006.01)
*B42D 15/02* (2006.01)

(52) U.S. Cl.
CPC ..... *B42D 15/045* (2013.01); *B42D 15/022* (2013.01)

(58) Field of Classification Search
CPC ..... G09F 1/00; B42D 15/02; B42D 15/04; B42D 15/045; B42D 15/0222
See application file for complete search history.

(56) References Cited

U.S. PATENT DOCUMENTS 7,552,553 B2 6/2009 Kelly
7,861,441 B1 1/2011 Hoellwarth
8,230,624 B2 7/2012 Sapp et al.
8,256,150 B2 9/2012 Qiao et al.
8,448,361 B2 5/2013 Sapp et al.
8,490,305 B2 7/2013 Qiao et al.
8,776,846 B1 * 7/2014 Thompson ..... A45C 11/182 150/138
D730,742 S 6/2015 Glass et al.
9,302,528 B2 4/2016 Shlonsky et al.
9,565,911 B2 2/2017 Glass et al.
9,597,916 B2 3/2017 Begin et al.
2004/0187368 A1 * 9/2004 Foster ..... G09F 1/04 40/124.06
2009/0126239 A1 5/2009 Clegg
2010/0052876 A1 3/2010 Clegg et al.
2012/0241348 A1 9/2012 Clegg
2013/0232828 A1 9/2013 Qiao et al.
2015/0197117 A1 * 7/2015 Begin et al. ..... B42D 15/022 40/124.03
2015/0224808 A1 8/2015 Shlonsky et al.
2017/0036812 A1 2/2017 Speck et al.
2017/0057273 A1 3/2017 Begin et al.

* cited by examiner

*Primary Examiner* — Cassandra H Davis
(74) *Attorney, Agent, or Firm* — Christine Flanagan

(57) ABSTRACT

A greeting card having a gift card holder attached thereto with motor module which is operative to cause movement to the gift card holder. The greeting card may additionally contain a mobile object attached to the gift card holder which moves out of synch with the gift card holder. The gift card holder may contain a first portion and a second portion which separate to reveal a gift card therein.

19 Claims, 5 Drawing Sheets

GREETING CARD WITH MOTORIZED GIFT CARD HOLDER

RELATED APPLICATIONS

There are no applications related to this application.

FIELD OF THE INVENTION

The present invention is in the field of social expression products, and more specifically to greeting cards with integrated gift card holders.

SUMMARY OF THE INVENTION

In one embodiment, the greeting card of the present disclosure and related inventions includes a greeting card body with one or more cavities therein, a motor module contained within the one or more cavities in the greeting card body, a first mobile object attached to the greeting card body, a second mobile object attached to the motor module, greeting card body and first mobile object, a switch contained within the greeting card body operative to control activation of the motor module, wherein when the motor module is activated, the first and second mobile objects move in opposing directions.

In another embodiment, the greeting card includes a greeting card body, a motor module contained within the greeting card body, a gift card holder attached to the motor module, a mobile object attached to the greeting card body and to the gift card holder, and a switch which controls activation of the motor module, causing movement of the gift card holder and mobile object.

In still another embodiment, the greeting card includes a greeting card body, a gift card holder attached to the greeting card body, the gift card holder comprising an open-sided pocket with pull-out panel, a motor module contained within the greeting card body operative to cause movement of the gift card holder, and a switch which controls activation of the motor module.

DETAILED DESCRIPTION OF PREFERRED AND ALTERNATE EMBODIMENTS

Figure 1:
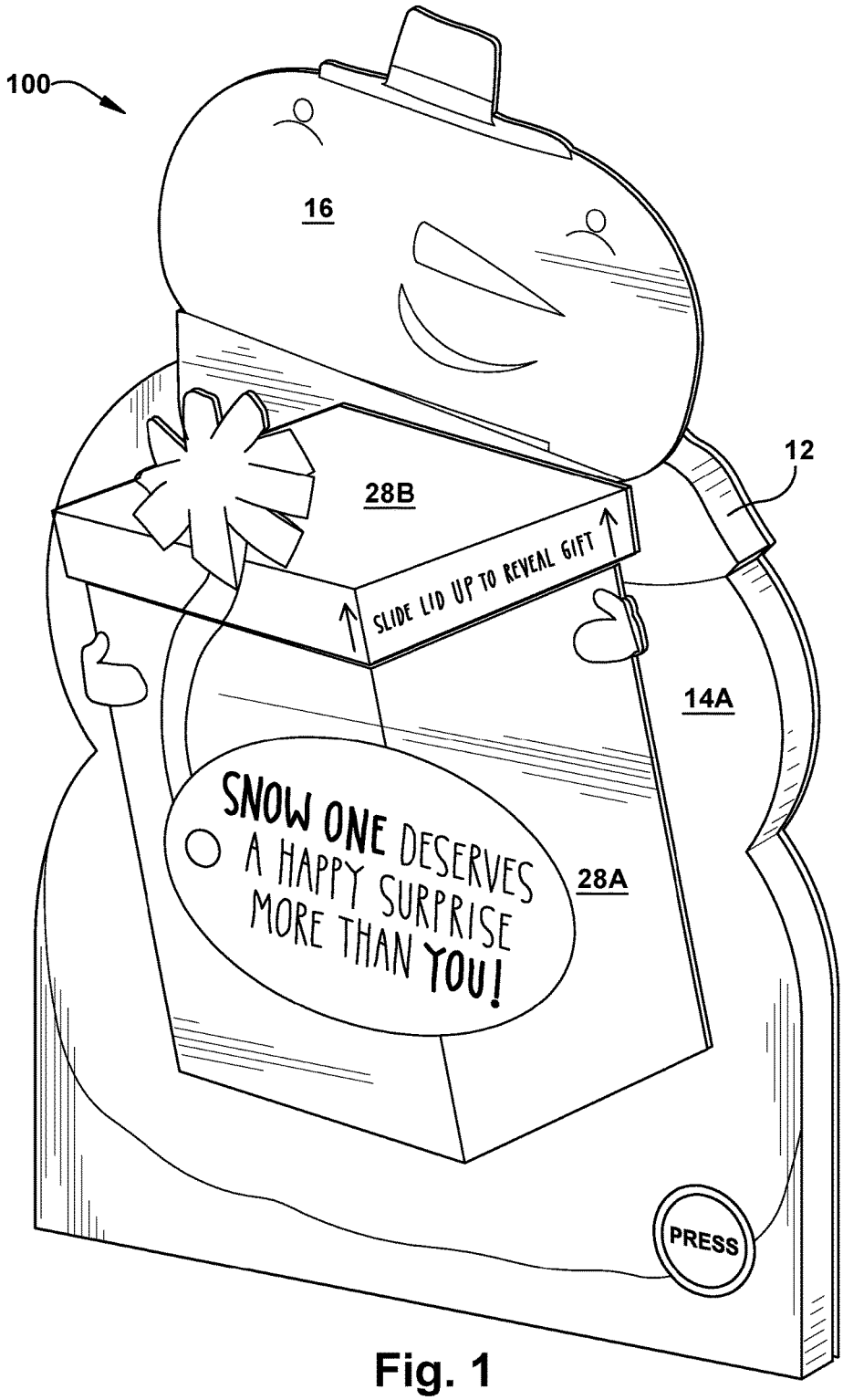
FIG. 1 is a perspective view of the GREETING CARD WITH MOTORIZED GIFT CARD HOLDER of the present invention, in a closed position.

The present invention includes a greeting card with an attached or integral gift card holder. The greeting card may contain audio capabilities and may include a motor to cause movement of the gift card holder.

In one embodiment, the greeting card 100 of the present disclosure and related inventions, contains a greeting card body with attached gift card holder. The body may include a foam core 12 (interchangeably referred to as "the core") which serves as the center or core of the greeting card 100. While the core 12 will be described herein as being made of foam, other materials, such as plastic or cardboard, have been contemplated and are considered to be within the scope of this invention. The core 12 contains a front surface, a rear surface and a perimeter surface which extends between the front and rear surfaces. In one embodiment, the front and rear surfaces of the core 12 are substantially planar. The core 12 may contain one or more compartments, openings, apertures, pockets or cavities therein. The core 12 may also be covered on the front and rear surfaces by a sheet material 14, such as paperboard or other such materials. A front and rear sheet materials 14A, 14B contain a front surface and a rear surface. In one embodiment, the front sheet material 14A is a single panel and the rear sheet material 14B is a single panel folded along a fold line F to create a first panel 14B1 and a second panel 14B2. In other embodiments, the front and rear surfaces may contain two or more panels which are either contiguous or otherwise attached. The rear surface of the front sheet material 14A is attached, via glue or other attachment mechanism or substance, to the front surface of the foam core 12. The rear surface of the first panel 14B1 of the rear sheet material 14B is attached to the rear surface of the foam core 12. The second panel 14B2 of the rear sheet material 14B is folded beneath the first panel 14B1 and may serve as a sentiment panel where greeting card sentiment may be printed and where a user may sign his/her name and add a personal, handwritten note. The front sheet material 14A and the first panel 14B1 of the rear sheet material 14B can be shaped exactly like or substantially similar to the shape of the foam core 12. This provides for precise application and a neat appearance. For example, as shown in the figures, the foam core 12, the front surface material 14A and the first panel 14B1 of the rear surface material 14B are shaped like the body of a snowman. In other embodiments, the front and rear sheet material 14A, 14B may take on a shape which is inconsistent with the shape of the foam core 12. In the embodiment shown in the figures, the second panel 14B2 of the rear surface material 14B may also be shaped exactly like or substantially like the foam core 12. Alternatively, the second panel 14B2 of the rear surface material 14B may have a standard square or rectangular shape or may take on any other conceivable shape and may have the same or similar height as the front and rear sheet material 14A, 14B or it may be a half panel or have any height which is less than the height of the front and rear sheet material 14A, 14B. Each of the front and rear surfaces of the front and rear sheet material 14A, 14B may contain text sentiment, artwork, including pictures, photos, drawings, etc. and any other printable material. In one embodiment, the front and rear surfaces of the front and rear sheet material 14A, 14B may contain additional embellishments, such as faux fur, gems, googly eyes, etc. The perimeter surface of the foam core 12, may be left uncovered or in some embodiments, may be covered by a material or substance. The front surface of the first sheet material 14A (as attached to the front surface of the foam core 12) serves as the front page or front cover of the greeting card 100. The front surface of the first panel 14B1 of the rear sheet material 14B serves as the inside left panel of the greeting card 100 and the front surface of the second panel 14B2 of the rear sheet material 14B serves as the inside right panel of the greeting card 100. The rear surface of the second panel 14B2 of the rear sheet material 14B serves as the back page or rear cover of the greeting card 100. The greeting card 100 opens and closes by pivoting the second panel 14B2 of the rear sheet material 14B towards and away from the first panel 14B1 of the rear surface material 14B (and foam core 12) about the fold line F which bisects the first 14B1 and second panels 14B2 of the rear sheet material 14B.

In one embodiment, a sound and motor module are contained within the greeting card 100. The sound module provides audio playback capabilities and the motor module provides the ability to cause movement of at least one mobile object 16 attached to or integral with the greeting card 100. The electronic and mechanical components of the sound and motor modules may be enclosed within one or more compartments, openings, apertures, pockets or cavities in the foam core 12. The electronic and mechanical components may include, but are not limited to: an electronic circuit with integrated circuit chip and controller 18, a power source such as one or more batteries 20, a speaker 22, a memory device (may be part of integrated circuit chip) onto which at least one audio file is saved, a switch 24, a motor 26, various wires and circuitry which connect various components, and any other component which is required for or which facilitates special effects such as audio playback of the at least one audio file and movement of at least one mobile object 16 attached to or integral with the greeting card 100. In one embodiment, the special effects are imitated by a push button switch 24. The push button switch 24, in one embodiment, may be accessed through a front surface of the greeting card body 100. The area above which the push button switch 24 is located may contain printing thereon indicating to the user where to push to trigger the special effects, such as "push", "press here" or other such indication. In other embodiments, the special effects may be initiated by a magnetic switch, a slide switch, a light sensitive switch, a motion sensitive switch, a contact switch, or any other suitable switch mechanism. Such electronic and mechanical components are known to one having skill in the art and will not be discussed herein in further detail.

In one embodiment, a mobile object 16 is attached, either directly or indirectly, to the motor module 26. The mobile object 16 may be a die cut shape. The die cut shape may be complementary to a design printed on the greeting card sheet material 14A, 14B. For example, as shown in the figures, the sheet material 14A, 14B may contain printing thereon which resembles the body of a snowman, and the die cut shape 16 may be shaped like the head of the snowman and having printing thereon resembling the head and/or face of the snowman.

Figure 2:
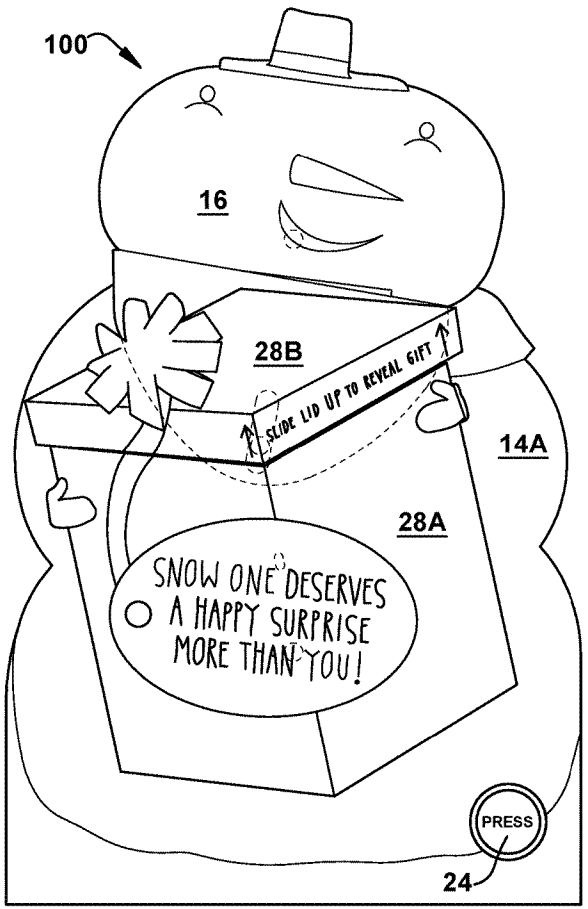
FIG. 2 is a front view of the GREETING CARD WITH MOTORIZED GIFT CARD HOLDER of FIG. 1.
Figure 3:
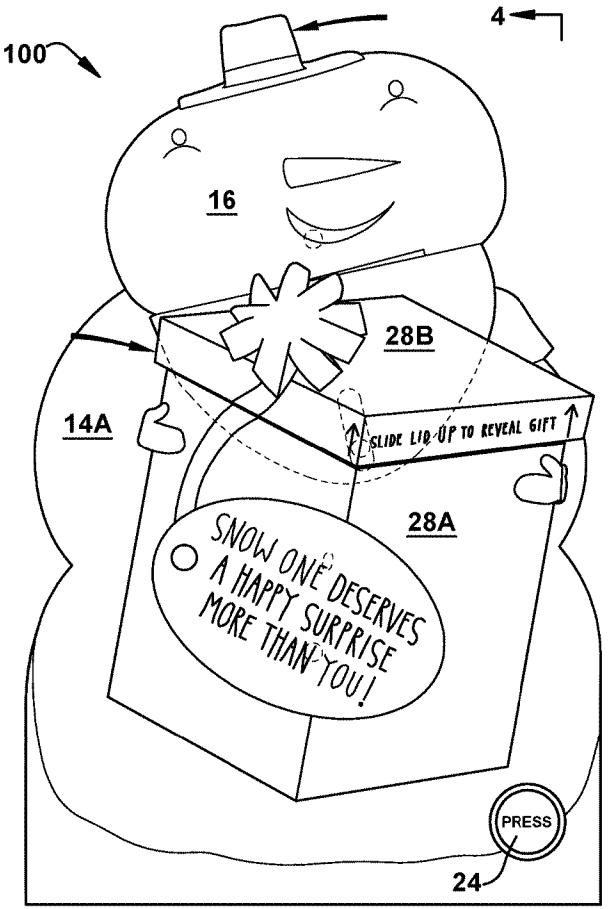
FIG. 3 is a front view of the GREETING CARD WITH MOTORIZED GIFT CARD HOLDER of FIG. 1, showing motion direction.
Figure 4:
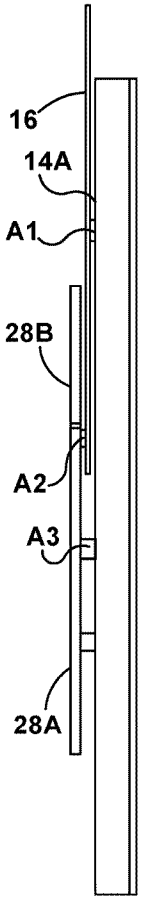
FIG. 4 is a side view of the GREETING CARD WITH MOTORIZED GIFT CARD HOLDER of FIG. 3, from the perspective of arrows 4-4.
Figure 5:
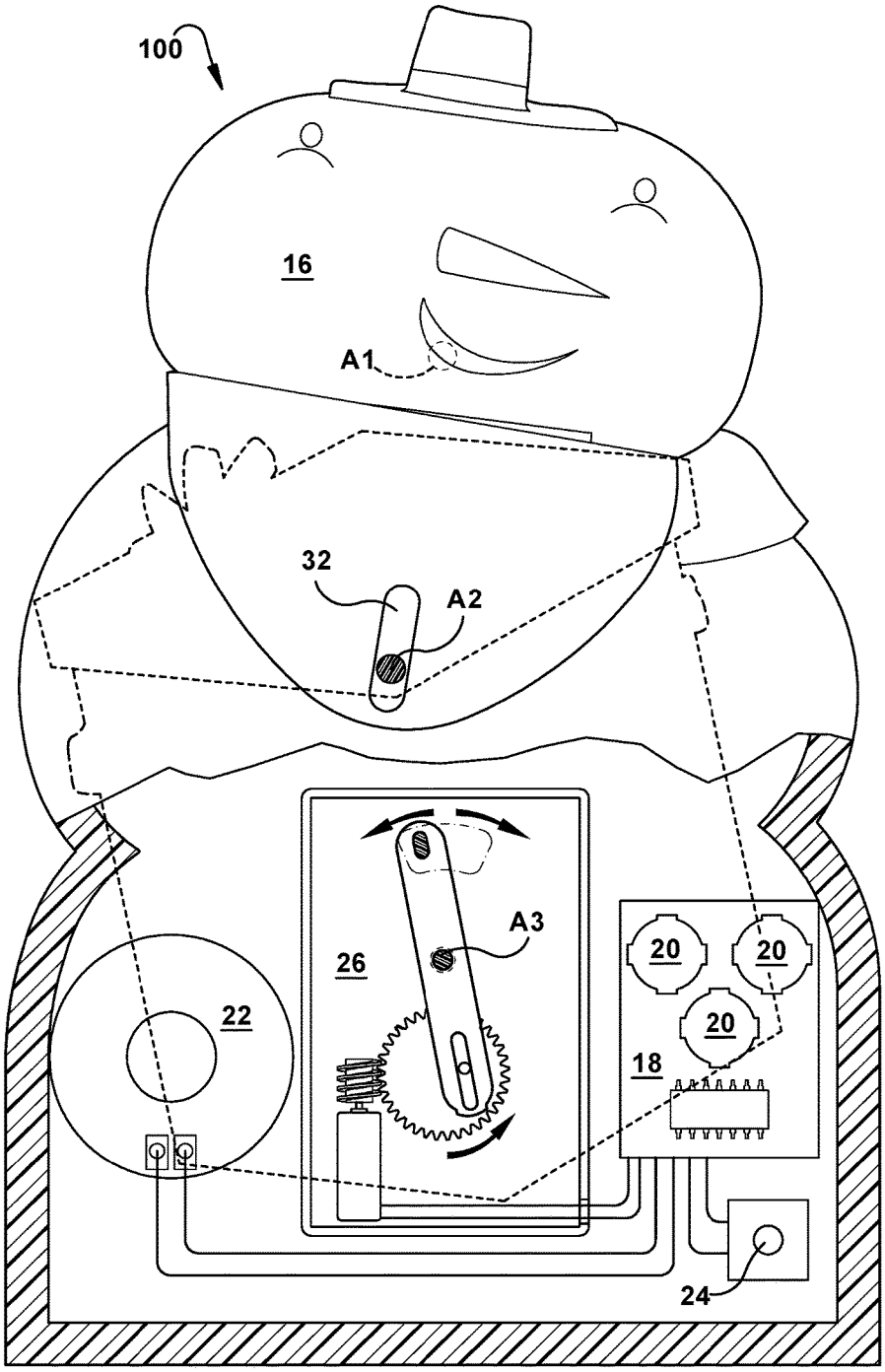
FIG. 5 is a front tear-away view of the GREETING CARD WITH MOTORIZED GIFT CARD HOLDER of FIG. 2.
Figure 7:
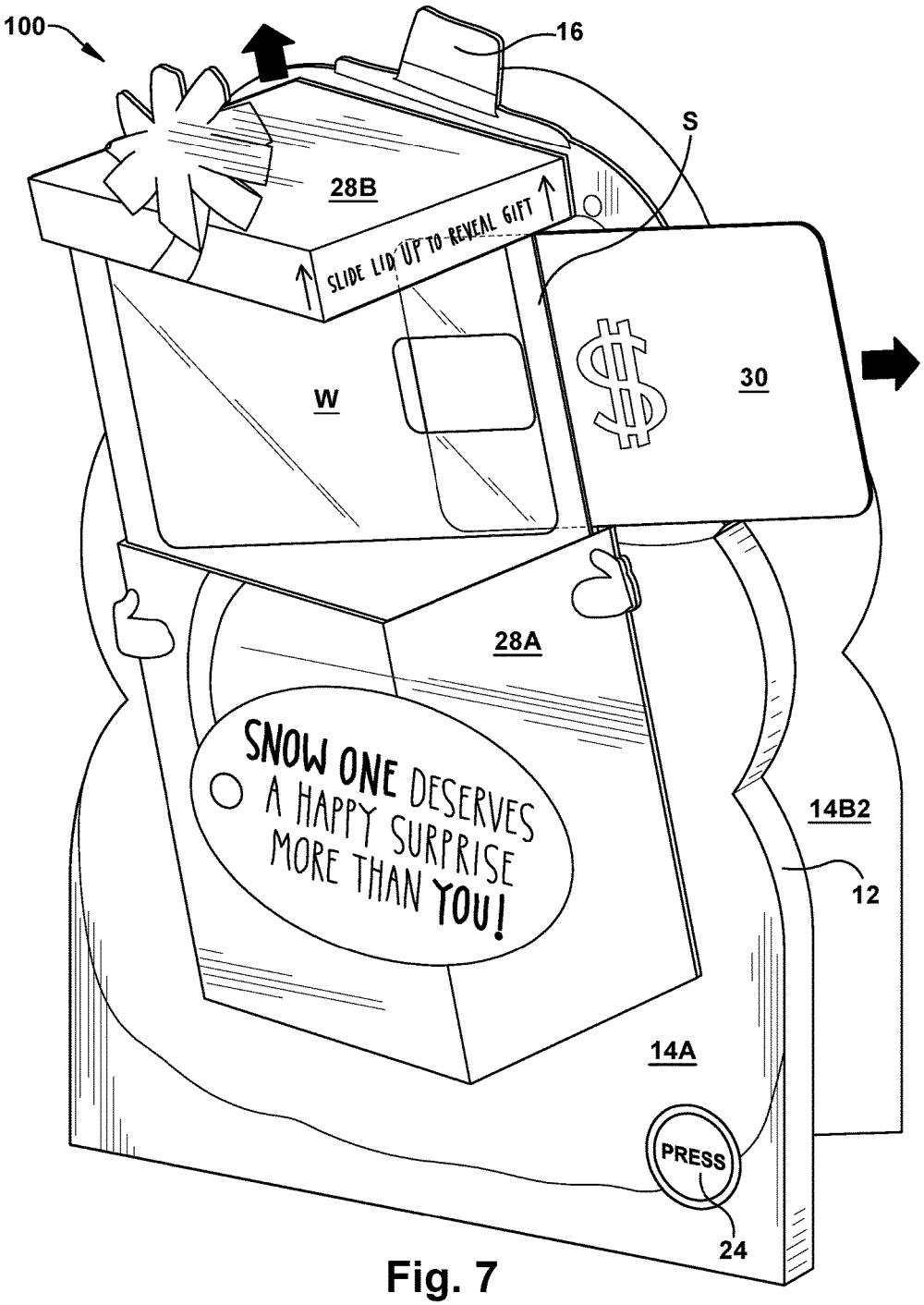
FIG. 7 is perspective view of the GREETING CARD WITH MOTORIZED GIFT CARD HOLDER of FIG. 1, with the gift card holder in an open position with partially removed gift card and the greeting card in a slightly open position.

In one embodiment, a second mobile object 28 is attached, either directly or indirectly, to the motor module 26. The second mobile object 28 may be a gift card holder. The gift card holder 28, in one embodiment, may contain a first portion 28A which is an open-sided pocket and a second portion 28B which is a pull-out panel (may also be referred to as a slide-out panel). The pull-out panel 28B may contain a slot S thereon for insertion and removal of a gift card 30. In one embodiment, the second mobile object 28 is located below the first mobile object 16, however, any other configuration may be used. As shown in the figures, the gift card holder 28 may be shaped like and contain printing thereon to resemble a gift box. The first or open-sided pocket portion 28A of the gift card holder 28 may be shaped like and contain printing thereon to resemble the bottom or receptacle portion of a box. The second or pull-out panel portion 28B of the gift card holder 28 may be shaped like and contain printing thereon to resemble a top or lid portion of a box. The first and second portions 28A, 28B of the gift card holder 28 may also contain printing thereon of hands or paws or the character or animal to present the impression that the character or animal contained on the front sheet material 14A and first mobile object 16, is grasping or holding the gift box. For example, in the embodiment shown in the figures, a snowman has two hands wrapped around the gift box. The first or open-sided pocket portion 28A may contain three closed sides and one open side. In one embodiment, the bottom, right and left sides of the pocket are closed and the top side (opposite the bottom side and between the right and left sides) is open for insertion of the second or pull-out panel portion 28B therein. The pull-out panel 28B may contain a slot S thereon with at least one open side for insertion and removal of a gift card 30. In one embodiment, the pull-out panel 28B may contain three closed sides and one open side with the top, bottom and left sides being closed and the right side (opposite the left side and between the top and bottom sides) being open. At least a portion of the pull-out panel 28B may be clear or transparent so that the front surface of a gift card 30 placed therein is visible to the recipient. The pull-out panel 28B may move from a first position, as shown in FIGS. 1 through 3, wherein the clear or transparent portion W is concealed within the pocket portion 28A of the gift card holder 28 and a second position, as shown in FIG. 7, wherein the clear or transparent portion W of the pull-out panel 28B is substantially outside of the pocket portion 28A of the gift card holder 28. A top or upper portion of the slide or pull out panel 28B is the portion which is shaped like and which contains printing thereon to resemble the top or lid portion of the box. This top or upper portion is wider than the open sided pocket 28A which serves as the lower or receptacle portion of the box such that the top or upper portion sits directly atop and outside of the lower or receptacle portion of the box with the slide or pull out panel 28B with the gift card slot S therebeneath and within the second or open-side pocket portion 28A of the gift card holder 28. To open the box or to move the pull or slide out panel 28B from the first position to the second position, the user may grasp the top or upper portion of the slide or pull out panel 28B between a thumb and index finger and pull in an upward directly to remove the slide or pull out panel 28B from the open-sided pocket 28A or lower or receptacle portion of the box. The second or slide or pull out panel portion 28B of the gift card holder 28 may contain two vertical slots thereon which engage with two small disk-shaped plates which prevent the second or pull out panel portion 28B from being completely removed from within the first or pocket portion 28A of the gift card holder 28.

Figure 6:
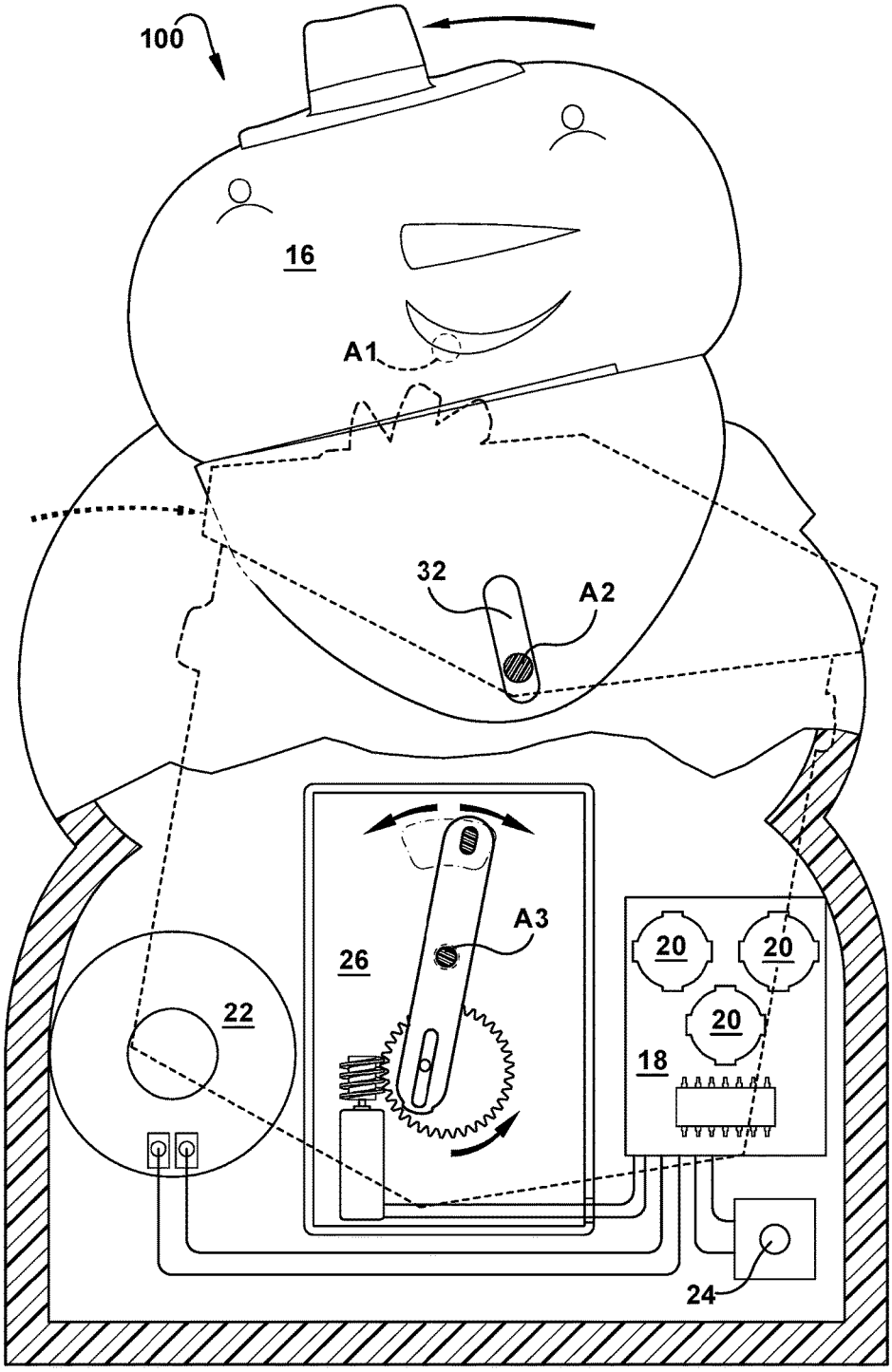
FIG. 6 is a front tear-away view of the GREETING CARD WITH MOTORIZED GIFT CARD HOLDER of FIG. 3.

In one embodiment, the first mobile object 16 is attached to the greeting card body at a first attachment point A1 and to the second mobile object 28 at a second attachment point A2. The first mobile object 16 is at least partially pivotable about both the first and second attachment points A1, A2. The first mobile object 16 contains an ovoid slot 32 along which the second attachment point A2 may move when the motor module 26 is activated. The second mobile object 28 may be attached directly to the motor module 26 through an opening in the first sheet material 14A attached to the front surface of the foam core 12. The second mobile object 28 is also attached to the greeting card body at a third attachment point A3. The second mobile object 28 is at least partially pivotable about the third attachment point A3. The motor module 26 causes the second mobile object 28 to move in a back-and-forth, left-to-right, or to-and-fro motion. The first mobile object 16 also moves in a back-and-forth, left-to-right, or to-and-fro motion in opposite time with the second mobile object 28. Therefore, when the motor module 26 is activated, the first and second mobile objects 16, 28 move in opposing back-and-forth, left-to-right, or to-and-fro motion, as shown in FIGS. 3 and 6.

In operation, the recipient receives the greeting card 100 and may open the greeting card 100 by pivoting the sentiment panel 14B2 away from the foam core 12 to read the printed sentiment and/or handwritten note written on the inside of the greeting card 100. The user may then press the press-button switch 24 to initiate playback of the at least one audio file and to set the first and second mobile objects 16, 28 in opposing back-and-forth motion. Once the sound and motor 26 modules are activated, pressing the press button 24 a second time will deactivate the sound and motor 26 modules. Pushing the press button 24 a third time will re-activate the sound and motor 26 modules, such that the press button 24 operates as an on/off or toggle switch. Once activated, the sound and motor 26 modules remain activated for a pre-determined period of time or until the user re-presses the press button 24. The second or pull-out portion 28B of the gift card holder 28 may contain printing thereon, such as, for example, "slide lid up to reveal gift", or other such phrase to indicate to the recipient that there is a gift contained therein. Grasping the second or pull-out panel portion 28B of the gift card holder 28, for example, between a thumb and forefinger, and lifting in an upward direction moves the second or pull-out panel portion 28B of the gift card holder 28 from the first position (shown in FIGS. 1 through 3), wherein the lower portion of the pull-out panel 28B (with gift card slot S) is concealed within the first or open-sided pocket portion 28A of the gift card holder 28A and the second position (shown in FIG. 7), wherein the lower portion of the pull-out panel 28B (with gift card slot S) is revealed or substantially outside of the first or open-sided pocket portion 28A of the gift card holder 28. A gift card 30 can be removed from the gift card slot S on the pull-out panel 28B.

While the greeting card of the present disclosure and related inventions has been described herein and shown in the figures as including a foam core, other materials may be used. Also, the gift card holder is described and shown as being an open-sided pocket with slide out panel with gift card slot. In other embodiments, the gift card holder may be an envelope, a box, a sleeve, a closed pocket, or any other openable container. The first and second mobile objects have been described and shown herein as being a die cut shape and a gift card holder, respectively, however, both mobile objects may be gift card holders and there may be additional mobile objects attached to the greeting card. Also, while the mobile objects have been described and shown as being attached to the front surface of the greeting card, they may be attached to a rear or inside panels of the greeting card. The switch has been described herein as a push button switch which controls activation of both the sound and motor modules. However, the switch may be a magnetic switch, a slide switch, a contact switch, a light sensitive switch, a touch sensitive switch or any other switch mechanism. Also, the greeting card may contain two separate switches which control the sound and motor modules. The two switches may be of the same or different types. In addition to the sound and motor modules, other embodiments may include additional special effects such as one or more lights, etc.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A greeting card comprising:

a greeting card body, having one or more cavities contained therein;

a motor module contained within the one or more cavities in the greeting card body;

a first mobile object attached to the greeting card body;

a second mobile object attached to the motor module and the first mobile object;

the second mobile object comprising a first element and a second element, the second element being partially inserted into the first element and the second element having an open sided pocket thereon;

a switch contained within the greeting card body which is operative to control activation of the motor module;

wherein the motor module causes movement to the first and second mobile objects when activated.

2. The greeting card of claim 1 further comprising a sound module operative to store and playback at least one audio file.

3. The greeting card of claim 2, wherein the switch controls activation of the sound module.

4. The greeting card of claim 1, wherein the switch is a push button switch.

5. The greeting card of claim 1, wherein the open sided pocket on the second element of the second mobile object is sized to accommodate a gift card.

6. The greeting card of claim 1, wherein the second element of the second mobile object is operative to move from a first position wherein the open sided pocket is concealed within the first element of the second mobile object and a second position wherein the open sided pocket is outside of the first element of the second mobile object.

7. A greeting card comprising:

a greeting card body;

a motor module contained within the greeting card body;

a gift card holder attached to the motor module;

a mobile object attached to the gift card holder;

a switch which controls activation of the motor module, causing movement of the gift card holder and mobile object;

wherein the gift card holder comprises an open sided pocket and a slide panel inserted into the open sided pocket, the slide panel having a slot thereon for holding a gift card.

8. The greeting card of claim 7 further comprising a sound module operative to store and playback at least one audio file.

9. The greeting card of claim 7, wherein the switch is a push button switch.

10. The greeting card of claim 7, wherein the gift card holder and mobile object are attached to a front surface of the greeting card.

11. The greeting card of claim 7, wherein the gift card holder and mobile object are pivotable with respect to one another.

12. The greeting card of claim 7, wherein the gift card holder and mobile object are pivotable with respect to the greeting card.

13. The greeting card of claim 7 further comprising a gift card contained within the gift card holder.

14. The greeting card of claim 7, wherein at least a portion of the slot on the slide panel is transparent.

15. A greeting card comprising:

a greeting card body;

a gift card holder attached to the greeting card body, the gift card holder comprising an open-sided pocket with pull-out panel, the pull-out panel having an opening thereon for insertion and removal of a gift card;

a motor module contained within the greeting card body operative to cause movement of the gift card holder;

a switch which controls activation of the motor module;

wherein the pull-out panel is operative to move between a first position wherein the opening on the pull-out panel is concealed within the open-sided pocket and a second position wherein the opening on the pull-out panel is outside of the open-sided pocket.

16. The greeting card of claim 15, wherein the pull-out panel cannot be fully removed from the open-sided pocket.

17. The greeting card of claim 15 further comprising a sound module operative to store and playback at least one audio file.

18. The greeting card of claim 15, wherein the switch is a push button switch.

19. The greeting card of claim 15, wherein the gift card holder is located on a front surface of the greeting card.

* * * * *